US007429685B2

(12) United States Patent
Bouchy et al.

(10) Patent No.: US 7,429,685 B2
(45) Date of Patent: Sep. 30, 2008

(54) METHOD FOR THE ISOMERISATION OF A C5-C8 FRACTION INVOLVING TWO PARALLEL REACTORS

(75) Inventors: Christophe Bouchy, Rueil Malmaison (FR); Olivier Ducreux, Bougival (FR); Elsa Jolimaitre, Lyons (FR); Paul Broutin, Chaponost (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 754 days.

(21) Appl. No.: 10/486,179

(22) PCT Filed: Jul. 8, 2002

(86) PCT No.: PCT/FR02/02385

§ 371 (c)(1),
(2), (4) Date: Aug. 9, 2004

(87) PCT Pub. No.: WO03/014265

PCT Pub. Date: Feb. 20, 2003

(65) Prior Publication Data

US 2004/0254415 A1 Dec. 16, 2004

(30) Foreign Application Priority Data

Aug. 6, 2001 (FR) ..... 01 10566

(51) Int. Cl.
*C07C 5/27* (2006.01)

(52) U.S. Cl. ..... 585/736; 585/741; 585/743; 585/750; 585/302; 585/301

(58) Field of Classification Search ..... 585/736, 585/737, 738, 741, 743, 750, 302, 301
See application file for complete search history.

(56) References Cited

U.S. PATENT DOCUMENTS

| | | | | |
|---|---|---|---|---|
| 2,399,765 | A * | 5/1946 | Shoemaker et al. | 585/301 |
| 2,434,437 | A * | 1/1948 | Ross | 585/745 |
| 2,944,959 | A | 7/1960 | Starnes et al. | |
| 3,619,408 | A | 11/1971 | Larson | |
| 5,994,607 | A | 11/1999 | Boucot et al. | |

FOREIGN PATENT DOCUMENTS

| | | |
|---|---|---|
| EP | 0256604 | 2/1988 |

* cited by examiner

*Primary Examiner*—Thuan Dinh Dang
(74) *Attorney, Agent, or Firm*—Millen, White, Zelano & Branigan, P.C.

(57) ABSTRACT

The invention relates to a method of isomerising a charge comprising hydrocarbons containing between 5 and 8 carbon atoms per molecule. According to the invention, said charge is separated into at least two fractions: fraction A mostly comprising hydrocarbons containing 5 or 6 carbon atoms and fraction B mostly comprising hydrocarbons containing 7 or 8 carbon atoms. Subsequently, said fractions A and B are treated separately under specific conditions in different isomerisation reaction zones.

11 Claims, No Drawings

METHOD FOR THE ISOMERISATION OF A C5-C8 FRACTION INVOLVING TWO PARALLEL REACTORS

The present invention relates to a process for isomerising a feed mainly comprising hydrocarbons containing 5 to 8 carbon atoms per molecule in the presence of hydrogen (also sometimes known as a hydroisomerisation process). In the description, the abbreviation "C5-C8 cut" will be used to designate a feed comprising normal-paraffins containing 5 to 8 carbon atoms per molecule.

Banning lead alkyls from automobile fuel, in particular for environmental protection reasons, has generated the development of processes for producing branched paraffins, which have a better octane number than linear compounds, in particular a process for isomerising normal-paraffins to branched paraffins. That process is gaining importance in the petroleum industry.

Current schemes for upgrading naphtha (C5-C10 cut) from atmospheric distillation usually comprise a fractionation producing:

a light naphtha (C5-C6 cut) sent to the isomerisation step;

a heavy naphtha (C7-C1 cut) sent to the reforming step.

The isomerisation product (or isomerate) is free of aromatic compounds, in contrast to the reformate, which generally contains a non negligible quantity (80 mole % and more). The isomerate and reformate are generally used in the gasoline pool which can also include other bases or additives: gasoline from fluidised bed catalytic cracking (FCC), alkylation products, methyl-tertiobutyl ether (MTBE), etc.

While aromatic compounds normally have high octane numbers, which are propitious for their use in spark ignition engines, increasingly severe regulations mean that the total amount of aromatic compounds in gasolines is having to be reduced. As an example, one European specification requires that the total aromatics content in superfuels must be reduced to a maximum of 35% by volume from 2005; that maximum is currently of the order of 42% by volume.

Thus, it is vital that novel processes for synthesising novel bases that are free of aromatic compounds but with high octane numbers be developed. A consideration of the octane numbers of different C7 isomers shows, for example, that normal-heptane (n-C7) isomers with a number of branches have a sufficiently high octane number to be above to be used directly in the gasoline pool. In contrast, isomers with only one branch have octane numbers that are insufficient to allow them to be added to the gasoline pool.

In addition, the isomerisation of paraffins containing 5 or 6 carbon atoms per molecule also results in the production of gasoline bases with high octane numbers that can also be incorporated directly into the gasoline pool. The isomerisation of C5-C6 paraffins has formed the basis of a great deal of study; three different catalyst types are traditionally used to carry out this isomerisation reaction:

Friedel-Crafts type catalysts such as catalysts containing aluminium chloride, used at low temperatures (about 20° C. to 130° C.);

catalysts based on metals from group VIII of the periodic table (Handbook of Chemistry and Physics, 45$^{th}$ Edition, 1964-1965) deposited on alumina and generally containing a halogen, used at medium temperatures (about 110° C. to 160° C.). U.S. Pat. No. 2,906,798, U.S. Pat. No. 2,998,398, U.S. Pat. No. 3,791,960, U.S. Pat. No. 4,113,789, U.S. Pat. No. 4,149,993 and U.S. Pat. No. 4,804,803 describe examples of such a catalyst type;

zeolitic catalysts comprising a metal from group VIII deposited on a zeolite, used at high temperatures (250° C. to 350° C.), those catalysts resulting in a mixture of hydrocarbons with an improved octane number but not as high as that obtained from processes using the catalysts cited above; however, they have the advantage of being easier to use and more resistant to poisons. Their low acidity means that they cannot be used for n-butane isomerisation. U.S. Pat. No. 4,727,217 describes an example of such a catalyst type.

Current processes for isomerising paraffins containing 5 and 6 carbon atoms using chlorinated alumina type catalysts and comprising platinum are high activity catalysts. Such processes are used without recycling or with partial recycling after fractionation of unconverted normal-paraffins, for example using molecular sieve systems. Such processes produce a fuel base containing no aromatic compounds and with a research octane number (RON) that is generally in the range 82 to 88, depending on whether the normal-paraffin isomerisation process does or does not include recycling.

A plurality of patents concern mono-metallic platinum based catalysts deposited on a halogenated alumina, and their use in normal-paraffin isomerisation processes. U.S. Pat. No. 3,963,643 involves a treatment with a Friedel-Crafts type compound followed by treatment with a chlorinated compound comprising at least two chlorine atoms, the treatment being more particularly applicable to straight chain hydrocarbons containing 4 to 6 carbon atoms. U.S. Pat. No. 5,166,121 describes acatalyst comprising gamma alumina formed into beads and comprising 0.1% to 3.5% by weight of halogen on the support.

A major disadvantage of such processes, as far as is publicly known, is that they cannot treat feeds containing more than about 2% by weight of normal-paraffins containing at least 7 carbon atoms per molecule. The operating conditions known to favour isomerisation of cuts containing paraffins containing 5 and 6 carbon atoms per molecule (i.e., more particularly the reaction temperature and the nature of the catalyst) result in cracking yields for paraffins containing at least 7 carbon atoms per molecule that are too high.

European patent EP-A1-0922747 proposes limiting the cracking yield for paraffins containing at least 7 carbon atoms per molecule when isomerising a C5-C8 cut by using an acid catalyst associated with relatively mild operating conditions. That catalyst contains at least one halogen and at least one group VIII metal, the reaction being carried out at a temperature in the range 30° C. to 150° C.

In its most general form, the present invention can substantially improve the octane numbers of products obtained by isomerising a feed mainly comprising hydrocarbons containing to 8 carbon atoms, and optionally a significant quantity of hydrocarbons containing 2 to 4 carbon atoms (at least 0.1% by weight).

More precisely, the present invention concerns a process for isomerising a feed comprising hydrocarbons containing 5 to 8 carbon atoms per molecule, in which said feed is separated into at least two fractions, a fraction A mainly comprising hydrocarbons containing 5 or 6 carbon atoms, and a fraction B mainly comprising hydrocarbons containing 7 or 8 carbon atoms, and in that said fractions A and B are then separately treated under specific conditions in distinct isomerisation reaction zones. The term "mainly" means that said fractions contain at least 50% of said hydrocarbons, preferably at least 80% of said hydrocarbons, and more preferably at least 95% of said hydrocarbons.

In general, said feed is itself a naphtha (C5-C10+cut), said fractionation then resulting in a fraction A (C5-C6) optionally also comprising C2-C4 hydrocarbons, a fraction B (C7-C8) and a heavy fraction C mainly comprising the heaviest hydrocarbons from the initial naphtha cut, i.e., containing at least 8 carbon atoms. Depending on the required specifications (for example regarding octane number), it is possible to carry out fractionation in which between 0 and 100 mole %, preferably between 0.1 and 50 mole % and more preferably between 0.1 and 10 mole % of the C8 present in the initial naphtha cut are finally present in fraction B.

The Applicant has discovered that separating said feed into two fractions and treating each fraction under specific operating conditions can firstly increase the degree of conversion of paraffins containing five or six carbon atoms and secondly, reduce the degree of cracking of hydrocarbons containing 7 and 8 carbon atoms. As a result, the present process can produce substantial gains in the, octane numbers of bases obtained after isomerisation.

In a first implementation of the invention, said reaction zones contain chemically different isomerisation catalysts.

Advantageously, the isomerising activity of the catalyst treating fraction A is higher than the isomerising activity of the catalyst treating fraction B.

In a second implementation of the invention, said reaction zones contain catalysts with the same chemical nature and the reaction temperatures are different.

The isomerisation catalysts for the process of the invention are typically included in the group constituted by: catalysts usually supported by a mineral support, typically an oxide and containing at least one halogen and at leastone group VIf metal, zeolitic catalysts containing at least one group VIf metal, Friedel-Crafts catalysts, acid or superacid HPA (heteropolyanion) type catalysts on zirconia, $WO_X$ (tungsten oxides) on zirconia, and sulphated zirconias. WOX catalysts (tungsten oxides) on zirconia have been described, for example, in "Oxide Catalysts and Catalyst Development", PHILLIPS M J and TERNAN M, eds, or in U.S. Pat. No. 5,422,327. Said BPA (heteropolyanion) type catalysts are described, for example in "Heteropoly and Isopoly Oxometallates", Springer-Verlag, M Thor Pope, Berlin, Heidelberg, New York, Tokyo, (1983) or in French patent FR-A-2 795 340. Other catalysts with an acidity that is comparable to that of the catalysts mentioned above can also be used, for example catalysts comprising at least one mica and/or trioctahedral vermiculites comprising pillars.

The typical total pressure in the isomerisation zones is about 0.1 to 10 MPa relative; the hourly space velocity is about 0.2 to 10 $h^{-1}$.

Two implementations of the invention can be considered, depending on the value of the excess of hydrogen with respect to the quantity of hydrogen consumed by the hydrogenation reactions and paraffin cracking reactions.

In a first implementation, at least one of the isomerisation reactions is carried out in the presence of an excess of hydrogen such that the ratio R of the number of moles of hydrogen to the number of moles of hydrocarbons leaving at least one reaction zone is in the range 0.06 to 0.3. In this case, it is not necessary to recycle the unconsumed hydrogen to the reactor inlet. We thus operate with "lost hydrogen".

In a second mode, at least one of the isomerisation reactions is carried out in the presence of an excess of hydrogen such that the ratio R of the number of moles of hydrogen to the number of moles of hydrocarbons leaving at least one reaction zone is between 0.3 and 30 and is more than 0.3. In this case, the excess hydrogen is recycled to the reactor inlet, for example using a recycle compressor after separating the cracking gases.

In accordance with the invention, it is possible to mix the isomerates from isomerising fractions A and B. It is also possible to separate said mixture into two effluents, the first of said effluents comprising the major portion of the isopentane and paraffins with at least two branches, the second of said effluents comprising the major portion of the normal-paraffins and paraffins containing at least six carbon atoms and a single branch, said second effluent being recycled and mixed with the feed or with fraction B.

In a further implementation, isomerate B-derived from isomerising fraction B is separated into two effluents, the first of said effluents comprising the major portion of the isopentane and paraffins with at least two branches, the second of said effluents comprising the major portion of the normal-paraffins and paraffins containing at least six carbon atoms and a single branch. Said second effluent is optionally recycled, i.e., for example, mixed with the feed or with fraction B. Advantageously, the first effluent is mixed with the isomerate from isomerising fraction A.

The fraction with the isopentane and paraffins containing at least two branches and/or the fraction with the normal-paraffins and paraffins containing at least six carbon atoms and a single branch contained in each of the effluents in each of the implementations of the invention will clearly be dependent on the nature of the separation means employed.

Said separation of said isomerate or isomerates into two effluents is carried out using any technique or process that is known, preferably by gas phase adsorption into a molecular sieve using pressure swing adsorption (PSA) processes that are known to the skilled person, or by simulated countercurrent processes. Said separation can advantageously employ at least one zeolitic adsorbent the structure type of which is included in the group constituted by: MFI (silicate, ZMS-5), FAU (X, Y, zeolites, faujasite), MIT (ZSM-23, EU-13), EUO (Eu1, ZSM-50, TPZ-3), NES (Nu-87, ssz-37), BEA (beta), MWW (N4CM-22, ERB-1, ITQ-1), MEL (ZSM-11). FER (ferrierite), MIW (ZSM-12), AFI (SAPO-5), ATO (SAPO-31), AEL (SAPO-11), ERI (erriobite), MOR (mordenite)—see the "Atlas of zeolite structure types", M. Meier and D H Olson, $4^{th}$ edition, (1996). Said zeolites can be exchanged with one or more cations from columns IA and IIA of the periodic table.

It is also possible to separate isomerate A derived from isomerising fraction A into two effluents, the first of said effluents comprising the major portion of the isopentane and paraffins with at least one branch, the second of said effluents comprising the major portion of the normal-paraffins, said second effluent being recycled and mixed with the feed or with fraction A.

Finally, said first effluent from isomerate A is mixed with said first effluent from isomerate B.

Said separation of said isomerate or isomerates from isomerising fraction A into two effluents can be carried out using any known technique, in particular using a deisohexaniser type distillation column, or by gas phase adsorption on a molecular sieve, for example as described in U.S. Pat. No. 5,233,120 or U.S. Pat. No. 5,602,291. Said separation advantageously employs an adsorbent as described in U.S. Pat. No. 2,882,243.

The invention will be better understood from the following examples that illustrate the invention without limiting its scope:

EXAMPLE 1

Prior Art

In this example, the method employed in Example 1 of European patent application EP-Al 0 922 747 was followed using a chlorinated alumina-based catalyst sold by Procatalyse under the trade name IS 612.

The operating conditions were as follows:

The isomerisation reactor was supplied with a feed comprising hydrocarbons containing 5 to 7 carbon atoms (C5-C7) at a flow rate of 87 g/h, said feed containing 800 ppm of perchloroethylene. The mass of catalyst present in the reactor was 86 g; the HSV was. 1.01 $h^{-1}$. The hydrogen flow rate was 4.5 l/h. The total pressure was 3 MPa relative. Isomerisation was carried out at a temperature of 115° C. and the ratio R of the number of moles of hydrogen to the number of moles of hydrocarbon at the reactor outlet was 0.11. The results obtained are shown in Table 1.

TABLE 1

| Compounds | C5–C7 feed (weight %) | After isomerisation |
|---|---|---|
| C2–C4 | 0.74 | 7.15 |
| Isopentane (iC5) | 4.19 | 7.62 |
| Normal pentane (nC5) | 10.53 | 7.50 |
| Cyclopentane | 0.28 | 0.28 |
| Isohexane (iC6) | 4.01 | 4.73 |
| Normal hexane (nC6) | 1.06 | 0.88 |
| Cyclohexane | 1.40 | 2.60 |
| Methylcyclopentane | 1.01 | 1.62 |
| Benzene | 0.01 | 0 |
| Normal heptane (nC7) | 65.07 | 17.35 |
| Isoheptane (iC7) | 11.70 | 50.27 |

| | Degree of conversion |
|---|---|
| nC5 | 29% |
| nC6 | 17% |
| nC7 | 73.6% |
| C5+ | 93.5% |

EXAMPLE 2

In Accordance with the Invention

The same catalyst, IS 612 A, was used here as was used in Example 1 in two distinct isomerisation reactors: reactor A for a synthetic feed mainly comprising hydrocarbons containing 5 or 6 carbon atoms (C5-C6 feed) and reactor B for a synthetic feed mainly comprising hydrocarbons containing 7 carbon atoms (C7 feed). By mixing feeds A and B, an initial C5-C7 feed that was identical to that for Example 1 was obtained. The percentages by weight of the different hydrocarbons in the C5-C6 feed (reactor A), the C7 feed (reactor B) and the total feed are shown in Table 2:

TABLE 2

| Compounds | C5–C6 synthetic feed (wt %) | C7 synthetic feed (wt %) | Total feed (% by weight) |
|---|---|---|---|
| C2–C4 | 3.18 | 0 | 0.74 |
| Isopentane (iC5) | 18.04 | 0 | 4.19 |
| Normal pentane (nC5) | 45.33 | 0 | 10.53 |
| Cyclopentane | 1.20 | 0 | 0.28 |
| Isohexane (iC6) | 17.26 | 0 | 4.01 |
| Normal hexane (nC6) | 4.56 | 0 | 1.06 |
| Cyclohexane | 6.03 | 0 | 1.40 |
| Methylcyclopentane | 4.36 | 0 | 1.01 |
| Benzene | 0.04 | 0 | 0.01 |
| Normal heptane (nC7) | 0 | 84.76 | 65.07 |
| Isoheptane (iC7) | 0 | 15.24 | 11.70 |

Isomerisation reactor A was supplied with C5-C6 feed at a flow rate of 20.21 g/h (grams per hour), said feed containing 800 ppm by weight of perchloroethylene ($C_2Cl_4$). The mass of catalyst present in reactor A was 20.01 g, the HSV (hourly space velocity) was 1.01 $h^{-1}$. The hydrogen flow rate was 1.4 l/h (litre per hour). The total pressure was 3 MPa relative. Isomerisation reactor A operated at 140° C. This temperature optimised conversion of C5 and C6 by approaching the thermodynamic equilibrium of the reaction. The ratio $R_A$ of the number of moles of hydrogen to the number of moles of hydrocarbon at the reactor A outlet was 0.19.

Isomerisation reactor B was supplied with feed C7 at a flow rate of 66.79 g/h, said feed containing 800 ppm by weight of perchloroethylene. The mass of catalyst present in reactor B was 66.13 g, the HSV was 1.01 $h^{-1}$. The hydrogen flow rate was 3.2 l/h. The total pressure was 3 MPa relative. The temperature of the isomerisation reaction in reactor B was fixed at 115° C. The ratio $R_B$ of the number of moles of hydrogen to the number of moles of hydrocarbon at the reactor B outlet was 0.19. The compositions of isomerates A and B from reactors A and B respectively and that of the mixture of these two isomerates are shown in Table 3 below.

TABLE 3

| Compounds | Isomerate A (wt %) | Isomerate B (wt %) | Isomerate A + B (wt %) |
|---|---|---|---|
| C2–C4 | 4.32 | 8.15 | 7.26 |
| iC5 | 43.14 | 0 | 10.02 |
| nC5 | 18.22 | 0 | 4.23 |
| Cyclopentane | 1.20 | 0 | 0.28 |
| iC6 | 19.54 | 0 | 4.54 |
| nC6 | 2.74 | 0 | 0.64 |
| Cyclohexane | 5.94 | 0 | 1.38 |
| Methylcyclopentane | 4.90 | 0 | 1.14 |
| Benzene | 0 | 0 | 0 |
| nC7 | 0 | 22.67 | 17.40 |
| iC7 | 0 | 69.18 | 53.11 |
| Reaction temperature | 140° C. | 115° C. | |

For each of the n-paraffins present in the feed, a degree of conversion was calculated from the composition of the mixture of the two isomerates.

The total degrees of conversion are given in Table 4:

TABLE 4

| | Degree of conversion |
|---|---|
| nC5 | 59.8% |
| nC6 | 39.6% |
| nC7 | 73.3% |
| C5+ | 93.4% |

The results shown in Table 4 show that, under operating conditions that are optimised compared with Example 1 and for an identical initial feed, the isomerisation scheme of the present invention can substantially improve nC5 and nC6 conversion while keeping the degree of conversion of normal-heptane and yield of hydrocarbons containing at least five carbon atoms (C5+) substantially identical. The octane number of the isomerisation products was thus improved in the process of the present invention.

EXAMPLE 3

In Accordance with the Invention

In this example, two different reactors were used as in Example 2, but the chemical nature of the catalysts was different: an acid catalyst (IS 612A) with a high activity for reactor A and a less acidic zeolitic Pt/H-beta catalyst that is more selective for isomerising nC7. Said zeolite is sold by Zeolyst and corresponded to the beta zeolite in the protonic form.

The initial feeds were similar to those given in Example 2 (Table 2).

Isomerisation reactor A was supplied with C5-C6 feed at a flow rate of 20.21 g/h, said feed containing 800 ppm by weight of perchloroethylene ($C_2Cl_4$). The mass of catalyst present in reactor A was 20.01 g, the HSV was 1.01 $h^{-1}$. The hydrogen flow rate was 1.4 l/h. The total pressure was 3 MPa relative.

Isomerisation reactor A operated at 140° C. The ratio $R_A$ of the number of moles of hydrogen to the number of moles of hydrocarbon at the reactor A outlet was 0.19.

Isomerisation reactor B was supplied with feed C7 at a flow rate of 66.79 g/h. The mass of catalyst present in reactor B was 22.26 g, the HSV was 3 $h^{-1}$. The hydrogen flow rate was 33.45 l/h. The total pressure was 3 MPa relative. The isomerisation reactor B operated at 240° C. to optimise the isoparaffin yield.

The ratio $R_B$ of the number of moles of hydrogen to the number of moles of hydrocarbon at the reactor B outlet was 1.86. The results obtained are shown in Table 5.

TABLE 5

| Compounds | Isomerate A (wt %) | Isomerate B (wt %) | Isomerate A + B (wt %) |
|---|---|---|---|
| C2–C4 | 4.32 | 5.39 | 5.14 |
| iC5 | 43.14 | 0 | 10.02 |
| nC5 | 18.22 | 0 | 4.23 |
| Cyclopentane | 1.20 | 0 | 0.28 |
| iC6 | 19.54 | 0 | 4.54 |
| nC6 | 2.74 | 0 | 0.64 |
| Cyclohexane | 5.94 | 0 | 1.38 |
| Methylcyclopentane | 4.90 | 0 | 1.14 |
| Benzene | 0 | 0 | 0 |
| nC7 | 0 | 22.07 | 16.94 |
| iC7 | 0 | 72.54 | 55.69 |
| Reaction temperature | 140° C. | 240° C. | |
| Catalyst | IS612A | Pt/H-beta | |

The total degrees of conversion are given in Table 6:

TABLE 6

| | A + B isomerisation |
|---|---|
| nC5 conversion | 59.8% |
| nC6 conversion | 39.6% |
| nC7 conversion | 74.0% |
| C5+ yield | 95.6% |

This example also appears to be more favourable than the example illustrating the prior art. For a comparable nC7 hydrocarbon conversion, the nC5 and nC6 conversion was substantially increased along with the C5+ yield. The present process can thus improve the octane numbers of isomerates, both by increasing the degree of conversion of hydrocarbons containing 5 to 6 carbon atoms, and by minimising the degree of cracking of hydrocarbons containing 7 carbon atoms.

The invention claimed is:

1. A process for isomerising paraffins in a feed comprising hydrocarbons containing 5 to 8 carbon atoms per molecule, characterized in that said feed is separated into at least two fractions, a fraction A mainly comprising hydrocarbons containing 5 or 6 carbon atoms, and a fraction B mainly comprising hydrocarbons containing 7 or 8 carbon atoms, and in which said fractions A and B are then separately treated under specific conditions in distinct isomerisation reaction zones wherein said reaction zones contain chemically different isomerisation catalysts in which the isomerisation activity of the catalyst treating fraction A is greater than the isomerising activity of the catalyst treating fraction B, in which at least one of the isomerisation reactions is carried out in the presence of an excess of hydrogen such that the ratio R of the number of moles of hydrogen to the number of moles of hydrocarbons leaving at least one reaction zone is in the range 0.06 to 0.3, and in which at least one of the isomerisation reactions is carried out in an excess of hydrogen such that the ratio R of the number of moles of hydrogen to the number of moles of hydrocarbons leaving at least one reaction zone is between 0.3 and 30.

2. A process according to claim 1, in which the isomerisation catalyst or catalysts comprise any from a group consisting of: supported catalysts containing at least one halogen and at least one group VIII metal, zeolitic catalysts containing at least one group VIII metal, Friedel-Crafts catalysts, superacid HPA on zirconia catalysts, tungsten oxides, on zirconia catalysts, and sulphated zirconias.

3. A process according to claim 1, in which the total pressure in the isomerisation reaction zones is about 0.1 to 10 MPa relative, the hourly space velocity being about 0.2 to $10^{-1}$.

4. A process according to claim 1, in which the isomerates from isomerising fractions A and B are then mixed.

5. A process according to claim 4, in which said mixture is separated into two effluents, the first of said effluents comprising the major portion of the isopentane and paraffins with at least two branches, the second of said effluents comprising the major portion of the normal-paraffins and paraffins containing at least six carbon atoms and a single branch, said second effluent being recycled and mixed with the feed or with fraction B.

6. A process according to claim 1, in which isomerate B derived from isomerising fraction B is separated into two effluents, the first of said effluents comprising the major portion of the isopentane and paraffins with at least two branches, the second of said effluents comprising the major portion of the normal-paraffins and paraffins containing at least six carbon atoms and a single branch, said second effluent being recycled and mixed with the feed or with fraction B.

7. A process according to claim 6, in which the first effluent is mixed with the isomerate derived from isomerising fraction A.

8. A process according to claim 6, in which isomerate A derived from isomerising fraction A is separated into two effluents, the first of said effluents comprising the major portion of the isopentane and paraffins with at least one branch, the second of said effluents comprising the major portion of the normal-paraffins, said second effluent being recycled and mixed with the feed or with fraction A.

9. A process according to claim 8, in which said first effluent from isomerate B is mixed with said first effluent from isomerate,A.

10. A process according to claim 1, wherein the catalyst for treating fraction A is a chlorinated alumina-based catalyst and the catalyst used for treating fraction B is a less acidic zeolite Pt/H-beta catalyst.

11. A process according to claim 1, wherein at least one catalyst is other than a Friedel-Crafts catalyst and is selected from the group consisting of supported catalysts containing at least one halogen and at least one group VIII metal, zeolitic catalysts containing at least one group VIII metal, superacid HPA on zirconia catalysts, tungsten oxides, on zirconia catalysts, and sulphated zirconias.

* * * * *

UNITED STATES PATENT AND TRADEMARK OFFICE

CERTIFICATE OF CORRECTION

PATENT NO. : 7,429,685 B2
APPLICATION NO. : 10/486179
DATED : September 30, 2008
INVENTOR(S) : Bouchy et al.

It is certified that error appears in the above-identified patent and that said Letters Patent is hereby corrected as shown below:

Column 8, line 23, change "$10^{-1}$" to --$10h^{-1}$--.

Signed and Sealed this

Thirty-first Day of March, 2009

JOHN DOLL
*Acting Director of the United States Patent and Trademark Office*